US006334227B1

(12) United States Patent
Larger

(10) Patent No.: US 6,334,227 B1
(45) Date of Patent: Jan. 1, 2002

(54) SEAT

(75) Inventor: Sophie Larger, Paris (FR)

(73) Assignee: Roset S.A. (FR)

( * ) Notice: Subject to any disclaimer, the term of this patent is extended or adjusted under 35 U.S.C. 154(b) by 0 days.

(21) Appl. No.: 09/222,636

(22) Filed: Dec. 29, 1998

(30) Foreign Application Priority Data

Dec. 30, 1997 (FR) ..... 97 16859

(51) Int. Cl.[7] ..... A47C 27/14

(52) U.S. Cl. ..... 5/653; 5/655.4; 5/911; 297/462

(58) Field of Search ..... 5/653, 655.4, 654, 5/702, 911, 689, 643, 644, 657.5; 297/462

(56) References Cited

U.S. PATENT DOCUMENTS 4,027,888 A 6/1977 Wilcox
4,667,356 A * 5/1987 Holmquist ..... 5/702
5,003,653 A * 4/1991 Mar ..... 5/654
5,634,223 A * 6/1997 Obermaier ..... 5/654

FOREIGN PATENT DOCUMENTS

| | | |
|---|---|---|
| FR | 1 556 716 | 2/1969 |
| FR | 2 517 946 | 6/1983 |
| GB | 1 516 644 | 7/1978 |
| GB | 1 189 130 | 4/1990 |

* cited by examiner

*Primary Examiner*—Lynne H. Browne
*Assistant Examiner*—Fredrick Conley
(74) *Attorney, Agent, or Firm*—Cantor Colburn LLP

(57) ABSTRACT

Seat that comprises an envelope containing incompressible filling pieces, such as polystyrene balls. In addition, this seat comprises a bottom wall and side walls made of a rigid, semirigid and/or impermeable material, and an upper wall of which at least a part is made of an elastic and permeable material, the filling pieces occupying the totality of the volume defined by the bottom, side and upper walls.

12 Claims, 2 Drawing Sheets

SEAT

BACKGROUND OF THE INVENTION

The present invention relates to a seat, and more especially a lounge seat that comprises an envelope containing incompressible filling pieces, such as polystyrene balls.

DESCRIPTION OF THE PRIOR ART

Seats of this type, in which the envelope, which is made, for example, of a textile material or an impervious synthetic substance, possesses an internal volume greater than the volume of balls forming the filling pieces. It is thus possible to displace the balls inside the bag to allow different configurations of the seat, and in particular to adapt the seat to the shape of the body of the user, in the sitting position. However, this type of seat does not have a very attractive appearance because there is a surplus of envelope to permit the displacement of the polystyrene balls, and, when the user leaves the seat, it remains in the position it had before the user got up.

The object of the invention is to provide a seat of this type, which adapts itself to the shape of the body of one or more users, and which returns automatically to an original position when the user gets up, in order to give the seat an attractive appearance when not in use.

SUMMARY OF THE INVENTION

To this end the seat to which it relates, of the aforementioned type, which comprises an envelope containing incompressible filling pieces, such as polystyrene balls, comprises a bottom wall and side walls made of a rigid, semirigid and/or impermeable material, and an upper wall of which at least a part is made of an elastic and permeable material, the filling pieces occupying the totality of the volume defined by the bottom, side and upper walls.

When the user sits down on the upper face of the seat, the upper face deforms to form a hollow in the sitting area, the balls moving away to form a seat back in an area where there is less pressure. This movement is made possible, even though the filling pieces occupy all the available volume, by the fact that air can pass through the material of the upper wall. Furthermore this deformation of the upper part is also made possible by reason of the lateral restriction of the side walls, owing to the nature of the material of which they are made. When the user gets up again, the permeability of the material of the upper wall, combined with the elasticity of this material, brings about another movement of the filling pieces until the upper wall forms a continuous surface.

In order to assist the lateral restriction of the filling pieces, the side walls comprise an inward rim made of the same material, where it meets the upper wall.

According to one feature of the invention, the bottom wall and/or the side walls are made from a sheet of flexible, impermeable and inextensible material.

According to one possibility in this case the bottom, side and upper walls are joined together, for example by sewing, and form a bag containing the filling pieces.

In another embodiment of this seat, the side walls consist of a belt, inside which is at least one bag containing the filling pieces, the upper wall of which is made of an elastic and permeable material.

According to a first possibility in this case, the belt consists of a rigid panel.

According to another possibility, the belt consists of a ring of homogeneous material, such as rubber or a synthetic foam, or consists of an inflatable ring.

BRIEF DESCRIPTION OF THE DRAWINGS

The invention will however be made clear in the following description, which refers to the accompanying diagrammatic drawing showing, by way of non-restrictive example, several embodiments of this seat.

DESCRIPTION OF THE PREFERRED EMBODIMENTS

Figure 1:
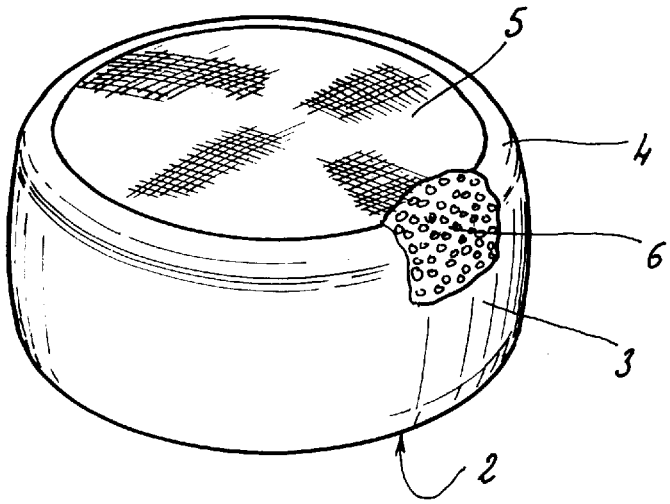
FIG. 1 is a perspective view of a first seat having the general form of a pouf.

FIG. 1 shows a pouf of cylindrical overall shape comprising a bottom wall 2 consisting of a sheet of impermeable and inextensible material, continued by a side wall 3 consisting of the same material, this side wall comprising a peripheral inward rim 4 where it meets the upper wall. The center of the upper wall is made from a sheet of elastic and permeable material 5. These various walls 2, 3 and 5 define a volume which is entirely filled with filling pieces 6 of small dimensions, such as polystyrene balls.

Figure 2:
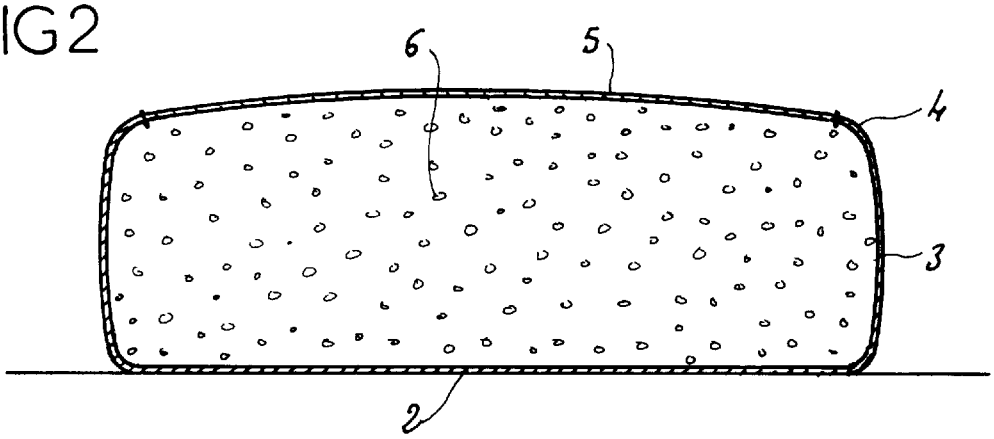
FIGS. 2 and 3 are two sectional views thereof in a non-use position and a use position, respectively.
Figure 3:
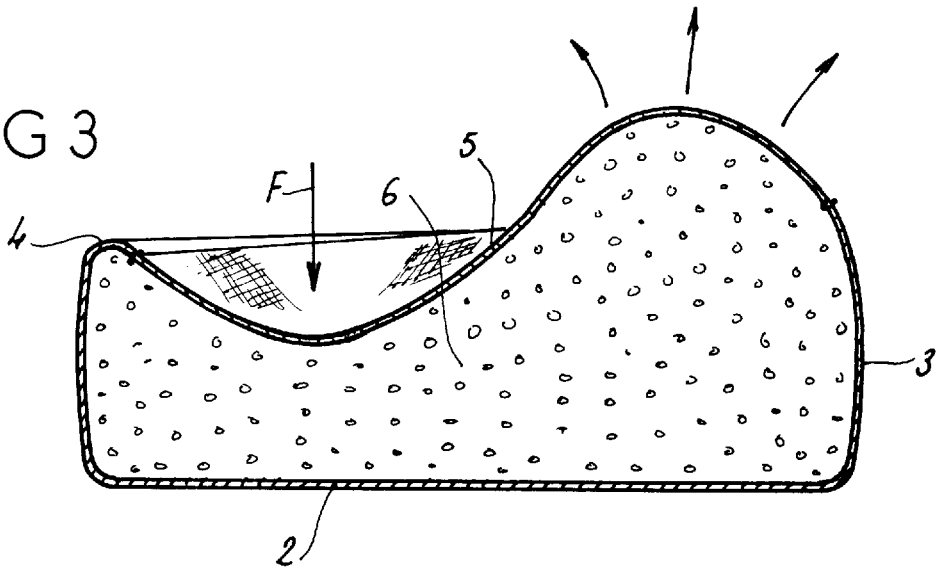

When the pouf is in the position of non-use it possesses the shape illustrated in FIG. 2. When a user sits on the pouf he or she exerts, on the seat, a downward pressure F having a tendency to form a hollow by the displacement of the balls into areas where less pressure is exerted. The balls are restricted laterally by the side wall owing to the nature of the material of the wall. Because the upper wall 5 is permeable, air can escape into areas where there is less pressure, as shown by arrows in FIG. 3, into which area the balls can move and form a seat back for the user.

When the user gets up again the reverse phenomenon occurs under the action of the elasticity of the upper wall 5, and the pouf returns to the position shown in FIG. 2, in which it is pleasing to the eye.

Figure 4:
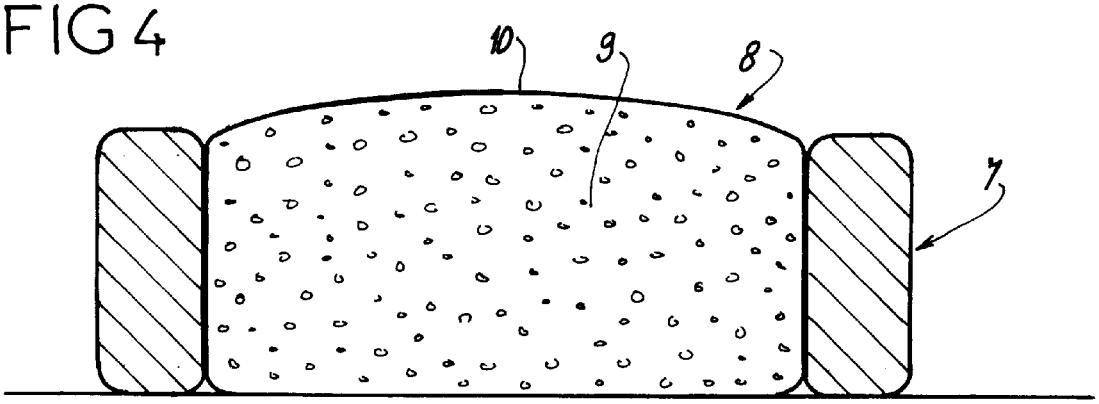
FIGS. 4 and 5 are two sectional views of two other seats, in a non-use position.

FIG. 4 shows a second embodiment of a seat according to the invention in which the outer wall 7 is formed by a ring independent of a bag 8 containing filling pieces 9. The ring 7 may be made of rubber or foam or be filled with air, the essential point being that it restricts the filling pieces and so prevents any outward movement thereof when pressure is exerted on the bag 8. As in the previous embodiment, at least the upper wall 10 of the bag 8 is made of a sheet of an elastic and permeable material.

Figure 5:
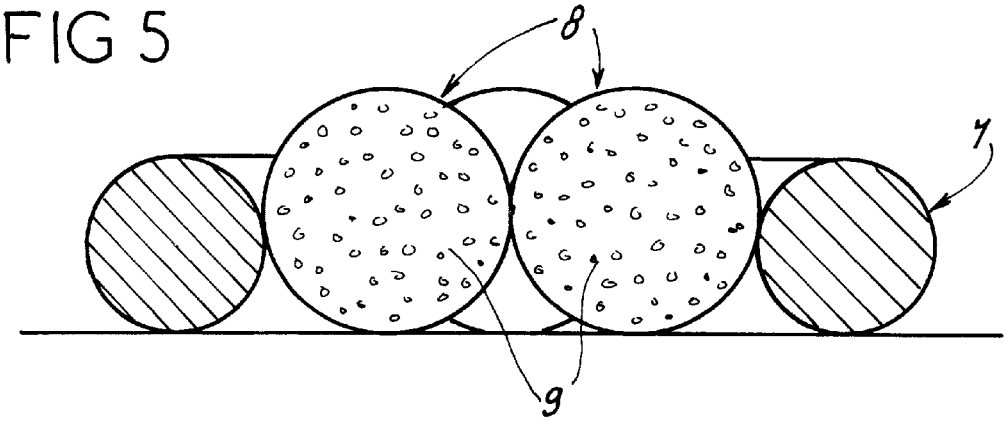

FIG. 5 shows a seat which represents an alternative embodiment of the seat shown in FIG. 4, in which identical elements are denoted by the same references as before. In this case the central part of the seat consists not of one bag 8 but of three bags 8.

As is clear from the foregoing, the invention greatly improves upon the existing art by providing a seat of simple structure which adapts itself to the shape of the body of the user or users and returns to its original position as soon as all pressure ceases to be exerted upon it.

As is self-evident, the invention is not limited to only those embodiments of the seat that are described above as examples, but on the contrary includes all variants. As an example, the side walls could be rigid panels, or the upper wall of the seat could comprise several areas made of an elastic and permeable material, without thereby departing from the scope of the invention.

What is claimed is:

1. A seat of an envelope type, comprising:

an upper wall;

a bottom wall;

a side wall; and incompressible filling pieces occupying a space defined by the bottom, side, and upper walls; and wherein the bottom wall and the side wall are impermeable and are made of a rigid or semirigid material and at least a portion of the upper wall is made of an elastic and permeable material.

2. The seat as set forth in claim 1, wherein the incompressible filling pieces comprise polystyrene balls.

3. The seat as set forth in claim 1, wherein the side wall includes an inward rim made of a same material as the side wall, the inward rim being located where the side wall meets the upper wall.

4. The seat as set forth in claim 1, wherein the bottom wall is a sheet of inextensible material.

5. The seat as set forth in claim 1, wherein the side wall is a sheet of inextensible material.

6. The seat as set forth in claim 1, wherein the bottom, side, and upper walls are joined together and form an envelope containing the incompressible filling pieces.

7. The seat as set forth in claim 6, wherein the bottom, side, and upper walls are joined together by a sewing process.

8. A seat comprising:

at least one envelope including an upper wall, a bottom wall, a side wall, and incompressible filling pieces occupying a space defined by the bottom, side, and upper walls, wherein the bottom wall and the side wall are impermeable, and are made of rigid or semirigid material, and at least a portion of the upper wall is made of an elastic and permeable material; and at least one belt removably attached to the side wall.

9. The seat as set forth in claim 8, wherein the belt comprises:

a rigid panel.

10. The seat as set forth in claim 8, wherein the belt comprises:

a ring of homogenous material.

11. The seat as set forth in claim 10, wherein the homogenous material is selected from the group consisting of a rubber and a synthetic foam.

12. The seat as set forth in claim 8, wherein the belt comprises:

an inflatable ring.

* * * * *